US006803850B2

(12) United States Patent
Richter

(10) Patent No.: US 6,803,850 B2
(45) Date of Patent: Oct. 12, 2004

(54) THERMAL TRIP ASSEMBLY AND METHOD FOR PRODUCING SAME

(75) Inventor: David Norman Richter, Mexico, MO (US)

(73) Assignee: Square D Company, Palatine, IL (US)

( * ) Notice: Subject to any disclaimer, the term of this patent is extended or adjusted under 35 U.S.C. 154(b) by 12 days.

(21) Appl. No.: 10/268,377

(22) Filed: Oct. 10, 2002

(65) Prior Publication Data

US 2004/0070483 A1 Apr. 15, 2004

(51) Int. Cl.[7] ..... H01H 73/48; H01H 37/52; H01H 37/02

(52) U.S. Cl. ..... 337/107; 337/82; 337/102; 337/103; 335/35; 335/45

(58) Field of Search ..... 337/23, 36, 37, 337/82, 102, 103, 104, 107; 335/35, 43, 45

(56) References Cited

U.S. PATENT DOCUMENTS 3,356,805 A * 12/1967 Gryctko ..... 337/146
3,562,584 A * 2/1971 Yoshimura ..... 361/13
4,675,641 A * 6/1987 Hampton et al. ..... 337/82
4,695,814 A * 9/1987 Matsumoto Yoshiaki et al. ..... 337/77
4,737,606 A 4/1988 Winter ..... 200/144 R
5,317,471 A * 5/1994 Izoard et al. ..... 361/105
5,500,496 A 3/1996 Venzke et al. ..... 200/339
5,539,167 A 7/1996 Hood et al. ..... 200/244
5,692,599 A 12/1997 Winter ..... 200/401
5,844,466 A * 12/1998 Fraisse ..... 337/379

FOREIGN PATENT DOCUMENTS

JP 01211824 A * 8/1989 ..... H01H/73/22

* cited by examiner

*Primary Examiner*—Anatoly Vortman
(74) *Attorney, Agent, or Firm*—Larry I. Golden

(57) ABSTRACT

A heater element for use in a circuit breaker whose initial shape can be varied to achieve various trip ratings for different circuit breakers. The material composition of the heater element and the bimetal strip indirectly heated by the heater element are kept the same. The electrical resistance presented to current passed through the heater element is varied by varying the shape of the heater element. The shape of one heater element relative to another heater element varies according to one geometric parameter. The geometric parameter may be surface geometry, thickness, or cross-sectional area.

10 Claims, 10 Drawing Sheets

THERMAL TRIP ASSEMBLY AND METHOD FOR PRODUCING SAME

FIELD OF THE INVENTION

This invention relates generally to circuit breakers and, more particularly, to a trip assembly for use in a circuit breaker.

BACKGROUND OF THE INVENTION

Circuit breakers typically provide automatic current interruption to a monitored circuit when undersired overcurrent conditions occur. These overcurrent conditions include, for example, overloads, ground faults, and short-circuits. An overcurrent is usually detected when the fault current generates sufficient heat in a strip composed of a resistive element or bimetal to cause the strip to deflect. The deflection triggers a trip assembly that includes a spring-biased latch mechanism to force a movable contact attached to a movable blade away from a stationary contact, thereby breaking the circuit. The strip is typically coupled to a heater which conducts the current-generated heat to the strip in a known manner. The current (within a predetermined threshold) at which the trip assembly is just prevented from acting yields the current rating for the circuit breaker. When the circuit is exposed to a current above that level for a predetermined period of time, the trip assembly activates and tripping occurs thereby opening the circuit.

To realize different current ratings, the compositions of the strips and/or heaters are varied. Varying the composition of a strip/heater causes the thermal behavior of each to change with a change in current rating. As a result, for each circuit breaker having a given current rating, a thermal analysis of the heater/strip assembly must be performed to ascertain the deflection of the strip versus time in response to heat generated by the heater.

For example, to produce an 80-amp circuit breaker and a 90-amp circuit breaker, the bimetal composition of the strips used in each breaker may be varied Each strip deflects differently in response to the same amount of heat. Generating the different deflection curves of each strip in response to a range of current is time intensive and is prone to error. Alternately, or additionally, the composition of the heaters used in each of the circuit breakers may be varied so as to alter the electrical resistance posed by the heater to throughgoing current. However, in this case, the varied compositions of the heaters produces different watts losses for each. This means that each heater generates a different amount of heat over a range of current. However, in order for the trip assembly for different breaker ratings to respond at a given overload, for example, 135% of the handle rating, in the same amount of time, the bimetal must deflect by the same amount. Thus, the heat generated in each case must be the same.

Accordingly, the strips attached to each heater, even if composed of the same bimetal, will deflect differently from one another. Thus, even if the heater composition is varied to achieve a desired current rating, multiple deflection curves must be generated.

Another disadvantage to the above approach is that for each additional current rating, at least one new material is introduced into the assembly process. Thus, for example, to manufacture a family of ten circuit breakers each having a unique current rating, as few as eleven and as many as twenty different materials must be kept on hand to assemble all ten circuit breakers. The multitude of different materials increases time, material and labor costs, and manufacturing complexity. For example, there may be a greater demand for a particular current rating, and to meet this greater demand, more materials destined for circuit breakers at the particular current rating must be kept on hand. Reducing the number of materials to achieve the same number of current ratings thus advantageously reduces the costs and complexities associated with producing circuit breakers having different ratings. The present invention exploits these and other advantages.

SUMMARY OF THE INVENTION

In an embodiment, a trip assembly for use in a circuit breaker includes a strip coupled to one of a first heater composed of a predetermined material and having a first cross-sectional area and a second heater also composed of the predetermined material and having a second cross-sectional area. The differences in the cross-sectional areas causes each heater to present a different electrical resistance to current passed through each heater.

In another embodiment, an arrangement of at least two heaters for use in circuit breakers having different current ratings includes a first heater composed of a predetermined material and a second heater also composed of the predetermined material. The second heater has a reduced shape relative to the shape of the first heater. As a result, the second heater presents a higher electrical resistance to throughgoing current than is presented by the first heater. The shape of the second heater may be reduced by varying surface area, thickness, or a cross-sectional area of the second heater.

In accordance with a method of assembling a trip assembly for use in one of a plurality of circuit breakers, the method includes forming a first heater composed of a predetermined material, forming a second heater also composed of the predetermined material such that the shape of the second heater differs from the shape of the first heater by at least one geometric parameter, and selecting and electrically coupling the first heater or the second heater to a thermally deflectable strip so as to achieve a desired thermal characteristic for a circuit breaker having a given current rating. The geometric parameter may be a surface area, cross-sectional area or a thickness.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

Figure 1:
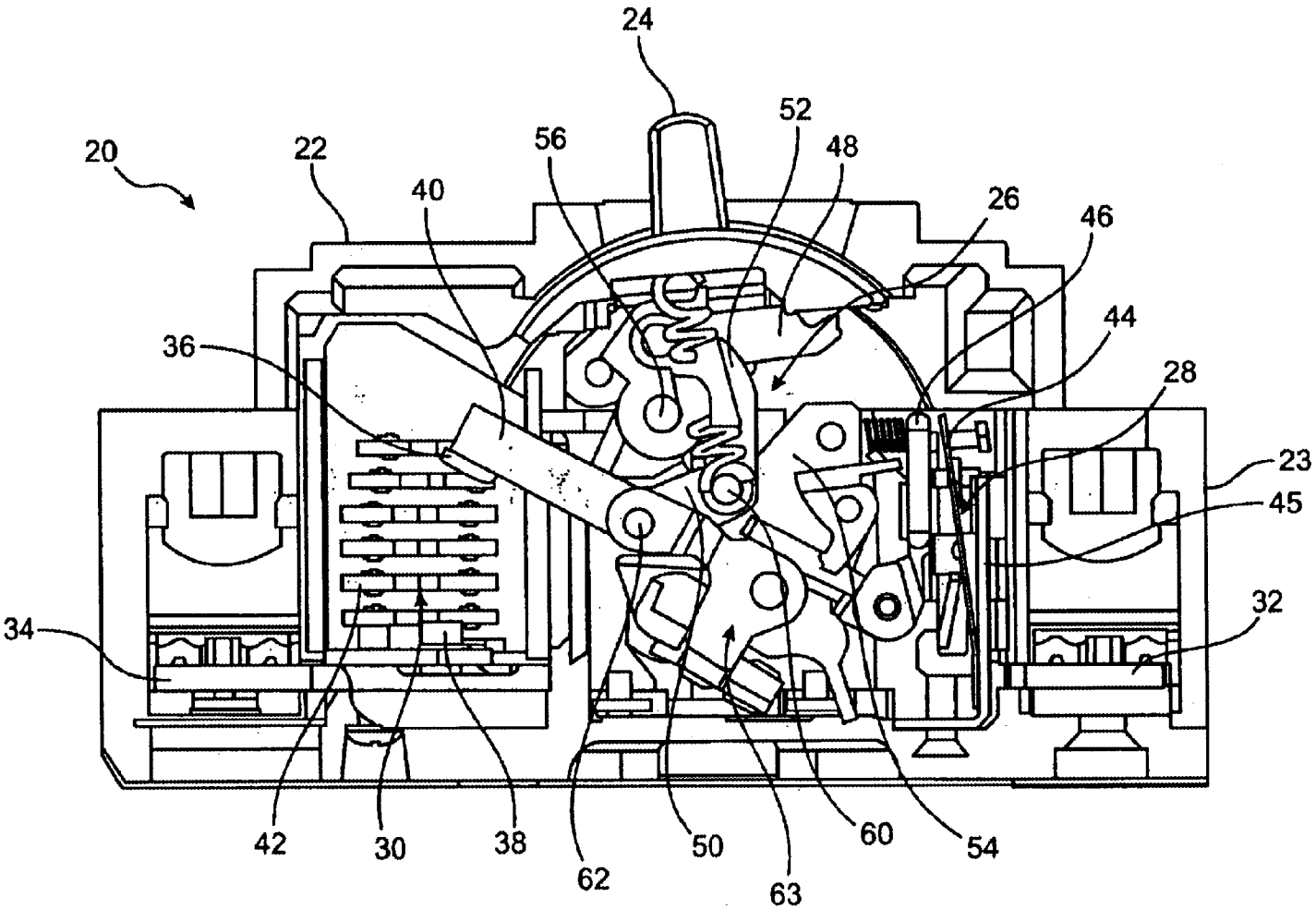
PRIOR ART Fig. 1
FIG. 1 is a cross-sectional diagrammatic schematic of a circuit breaker embodying the present invention, shown in a TRIPPED position.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Referring now to the drawings, and initially to FIG. 1, an electro-mechanical device such as a circuit breaker 20 will be described in general. The circuit breaker 20 generally includes a cover 22, a base 23, a handle 24, a switching mechanism 26, a trip assembly 28, and an arc-extinguishing assembly 30.

In general, most components of the circuit breaker 20 are installed on the base 23 and secured therein after a cover 22 is attached to the base. The handle 24 protrudes through the cover 22 for manual resetting of the circuit breaker 20. The handle 24 is also adapted to serve as a visual indication of one of several positions of the circuit breaker 20. One position of the circuit breaker 20 is an ON position. When the circuit breaker 20 is in the ON position, current flows unrestricted through the circuit breaker 20 and, therefore, through the electrical device or circuit that the circuit breaker is designed to protect. Another position of the circuit breaker 20 is a TRIPPED position, which is shown in FIG. 1. The TRIPPED position interrupts the flow of current through the circuit breaker 20 and, consequently, through the electrical device or circuit that the circuit breaker is designed to protect.

The TRIPPED position is caused by the presence of a higher current than the rated current for the circuit breaker 20 over a specified period of time. The exposure of the circuit breaker 20 over the specified period of time to a current that exceeds the rated current by a predetermined threshold activates the trip assembly 28. Activation of the trip assembly 28 causes the switching mechanism 26 to interrupt current flow through the circuit breaker 20.

Current enters the circuit breaker 20 through a first contact 32 and exits the circuit breaker 20 through a second contact 34. The current also passes through a pair of contacts, a movable contact 36 and a stationary contact 38. The movable contact 36 is attached to a blade 40, which is connected to the switching mechanism 26. In the ON position the movable contact 36 contacts the stationary contact 38, while in the TRIPPED position, the movable contact 36 is separated from the stationary contact 38, as shown in FIG. 1.

The trip assembly 28 is an assembly that drives the tripping action and generally includes a bimetal strip 44 connected to a heater 45. The bimetal strip 44 is thermally deflectable and is positioned proximate a trip cross bar 46. Current passing through the heater 45 generates heat which is conducted from the heater 45 to the bimetal strip 44. The higher the current, the more heat is generated. As the bimetal strip 44 is heated, it begins to deflect toward the trip cross bar 46. Continued deflection of the bimetal strip 44 eventually causes the trip cross bar 46 to activate the switching mechanism 26, which in turn causes the movable contact 36 connected to the blade 40 to move away from the stationary contact 38. As explained above, the switching mechanism 26 is activated when the current exceeds the rated current by a predetermined threshold over a specified period of time.

As the blade 40 moves away from the stationary contact 38, it passes through the arc-extinguishing assembly 30 which dissipates electrical arcs that are generated during separation of the movable contact 36 from the stationary contact 38. The arc-extinguishing assembly 30 includes an arc stack having a number of arc plates 42 which are offset at equal distances from one another and are supported by an insulating plate. The plates 42 are generally rectangular in shape, identical to one another, and interconnected. Each plate 42 has an arc throat that creates a path for the blade 40 to open when the circuit breaker 20 is tripped, or to close when the circuit breaker 20 is reset. The path is formed by laterally offsetting the identical arc plates 42 relative to one another in the same direction, tracing the imaginary radius that the blade 40 creates when opening or when closing.

The switching mechanism 26 generally includes a trip lever 48, a lower link 50, an upper link 52, and a frame structure 54. The trip lever 48 is pivotally connected by a trip lever pin 56 to the frame structure 54, and by an upper pin (not shown) to the upper link 52. The upper link 52 is connected by a joint pin 60 to the lower link 50, which is in turn connected by a blade carrier pin 62 to a blade carrier assembly 63.

Figure 2:
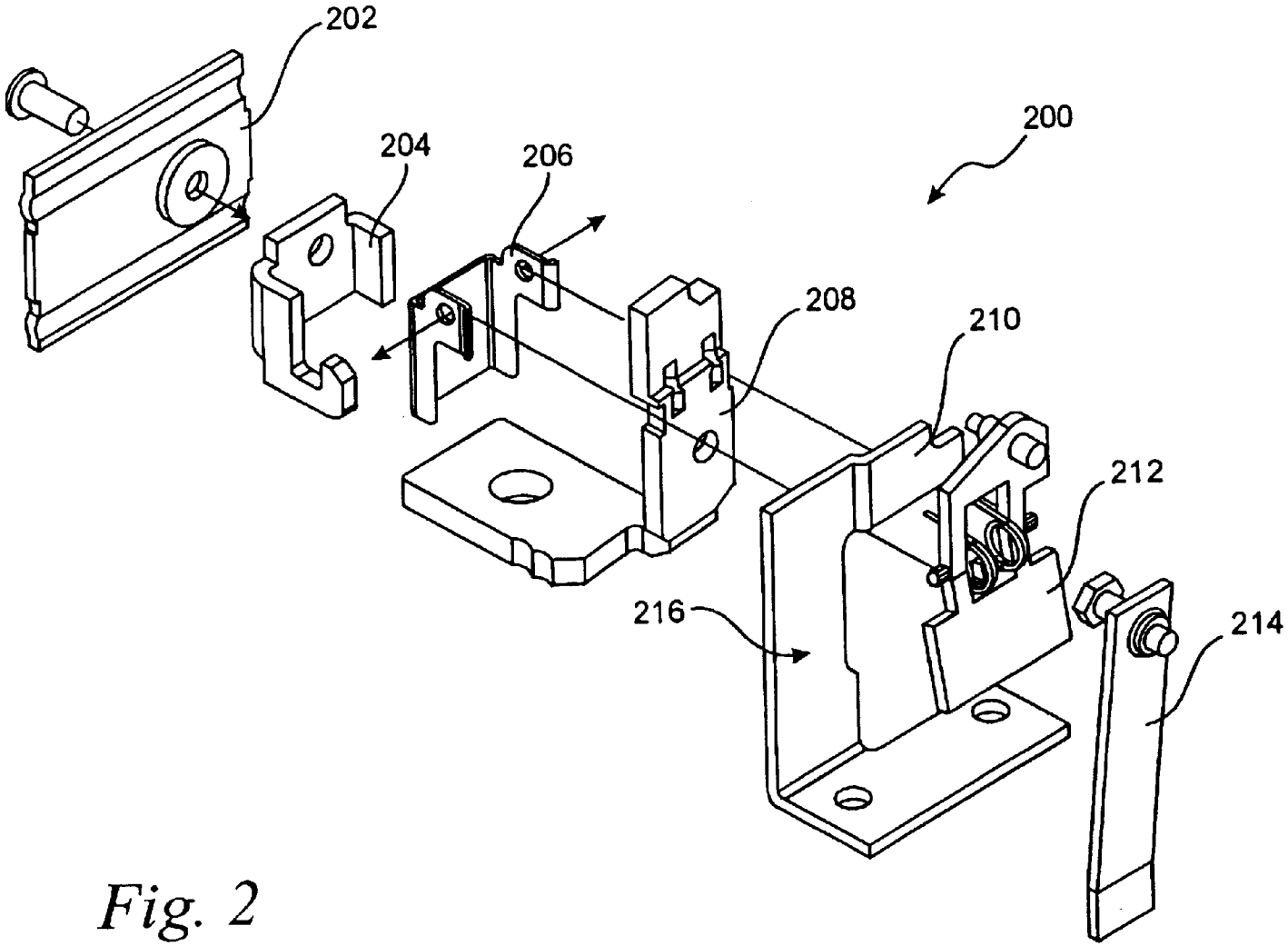
FIG. 2 is an exploded view of a trip assembly in accordance with one aspect of the present invention.

FIG. 2 is an exploded view of a trip assembly 200 according to a specific embodiment of the present invention. The trip assembly 200 generally includes a barrier 202, a yoke 204, an insert 206, a load terminal 208, a heater 210, a spring-based armature 212, and a bimetal strip 214. In an embodiment, the trip assembly 200 is used as the trip assembly 28 of the circuit breaker 20 shown in FIG. 1. The spring-biased armature 212 is coupled to a trip cross bar, such as the trip cross bar 46, and activates the trip cross bar 46 in response to detection of a short circuit condition. Because a short circuit condition is a sudden event that could send a damaging spike of current through the electrical circuit to which the circuit breaker 20 is connected, the spring-biased armature 212 provides a bypass to directly trip the trip cross bar 46 rather than allowing a time to pass while the strip 214 deflects sufficiently to trip the cross bar 46. The yoke 204, the insert 206, the load terminal 208, and the spring-biased armature 212 cooperate as shown to hold the spring-biased armature 212 in position.

The heater 210 is composed of an electrically conductive material that produces a predetermined thermal characteristic for the current rating for the circuit breaker 20. A predetermined thermal characteristic is watts loss. Another predetermined thermal characteristic is a thermal behavior over a predetermined period of time. A current rating may be expressed in terms of an amount of current (in amperes) within a predetermined tolerance which must be present to trip the circuit breaker 20 and/or a predetermined amount of time during which the current must be present to trip the circuit breaker 20.

In a specific embodiment, the heater 210 is composed of a copper alloy such as CDA 706, pure copper, stainless steel, or nichrome, though any other suitable material may be used without departing from the scope of the present invention. For example, CDA 706 is particularly well suited for current ratings of around 80 A, but CDA 110 is better suited for current ratings of around 225 A because of its lower resistance. Nichrome is well suited for current ratings of around 15 A. Preferably, the material is also selected such that the heater 210 is not adversely affected by the high current that is encountered during short circuits. As is known, the heater 210 has an electrical resistance. When electrical current passes through the heater 210, a small voltage drop occurs, and the lost energy is given off as thermal energy. This loss of energy is expressed in terms of watts loss. The resistance of the heater 210 may be varied either by altering the material composition of the heater 210, as is conventionally known, or, in accordance with an aspect of the present invention, by altering the cross-sectional area of a portion of the heater through which current flows. A lower current rating is achieved by decreasing the cross-sectional area while maintaining the watts loss constant. Conversely, a higher ampere rating is achieved by increasing the cross-sectional area while maintaining the watts loss constant. These relationships are governed by the following conventionally known equations:

$$r = \frac{\rho L}{A} \text{ and } W = rI^2 \text{ or } W = \frac{\rho L I^2}{A},$$

where r is the electrical resistance of the heater 210, p is resistivity of the heater 210, A is the cross-sectional area presented to the current I, L is the length along which the current I flows, and W is the watts loss of the heater 210. Using these equations, one can solve for A to determine the geometry of the heater for a desired current I.

The heater 210 shown in FIG. 2 has a relatively complex geometry which is composed of several sections. Thus, the geometry of the heater 210 must be mathematically broken into the several sections, with separate calculations performed on each section. The plate section 216 is of primary interest because this section is varied to achieve different current ratings. The other sections are not varied from heater to heater, so only one calculation needs to be performed on these sections. It should be noted that the present invention is not limited to any particular geometry, and a heater may have a more complex or less complex geometry than the heater 210 shown in FIG. 2 without departing from the scope of the present invention.

The strip 214 is connected to the heater 210 such that when the heater 210 produces heat in response to a current passed through it, the heat is conducted to the strip 214 via the connection. The strip 214 is thermally deflectable, which means that it deflects or bends in response to thermal energy. In the arrangement shown in FIG. 2, the strip 214 is not part of the current path, and therefore is indirectly heated via the heater 210. The strip 214 is preferably a bimetal composed of two or three metals though bimetals composed of more than three metals may be employed. A specific example of a bimetal suitable for use in circuit breakers having a current rating of around 80 A is P150RC, manufactured by Engineering Materials. Another example of a bimetal suitable for use in circuit breakers having a current rating of around 15 A is D560R also manufactured by Engineering Materials. Those skilled in the art will appreciate that there are numerous commercially available bimetals which are suitable for use in the present invention.

To quantify the behavior of a bimetal in response to thermal energy, a deflection curve is generated showing the amount of deflection in response to an amount of thermal energy Bimetals of different compositions will produce different deflection plots. Thus, as conventionally known, another way to alter the current rating of a circuit breaker is to vary the composition of the bimetal.

The present invention avoids the need to alter the composition of the bimetal to achieve different current ratings. Because the geometry of the heater is varied to achieve a target watts loss for different current ratings, the deflection plot of the strip 214 also remains the same as long as its composition is not varied. According to the present invention, by maintaining the compositions of the heater 210 and the strip 214 constant, different current ratings can be achieved simply by varying the geometric shape of the heater 210.

Figure 6:
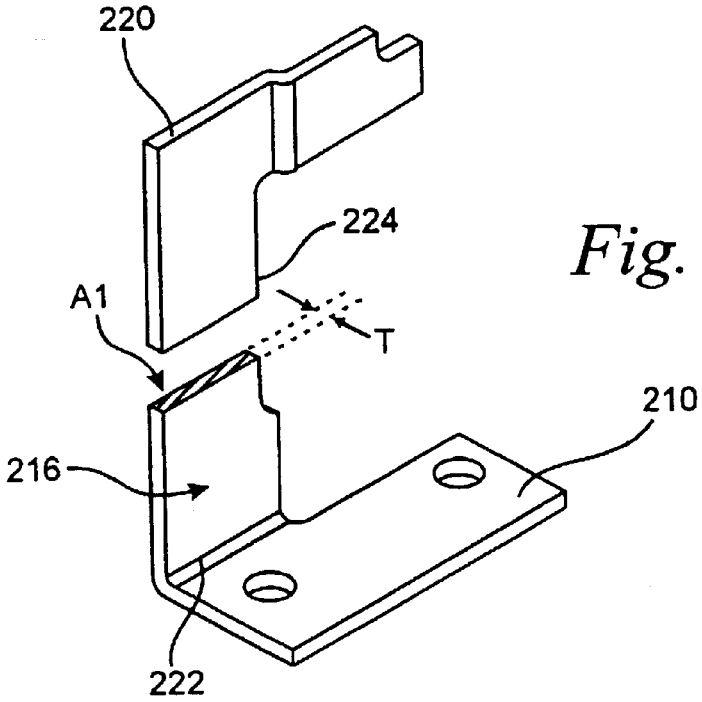
FIG. 6 is a perspective cutaway view of the heater shown in FIG. 2.

The geometry of the heater 210 includes several sections, any of which may be varied to achieve the desired current rating for the circuit breaker. In the illustrated embodiments, a plate section 216 of the heater 210 may be varied to achieve different current ratings. In FIG. 6, the heater 210 has been broken apart into two pieces for illustrative purposes to show the cross-sectional area A1 of the plate section 216.

Figure 3:
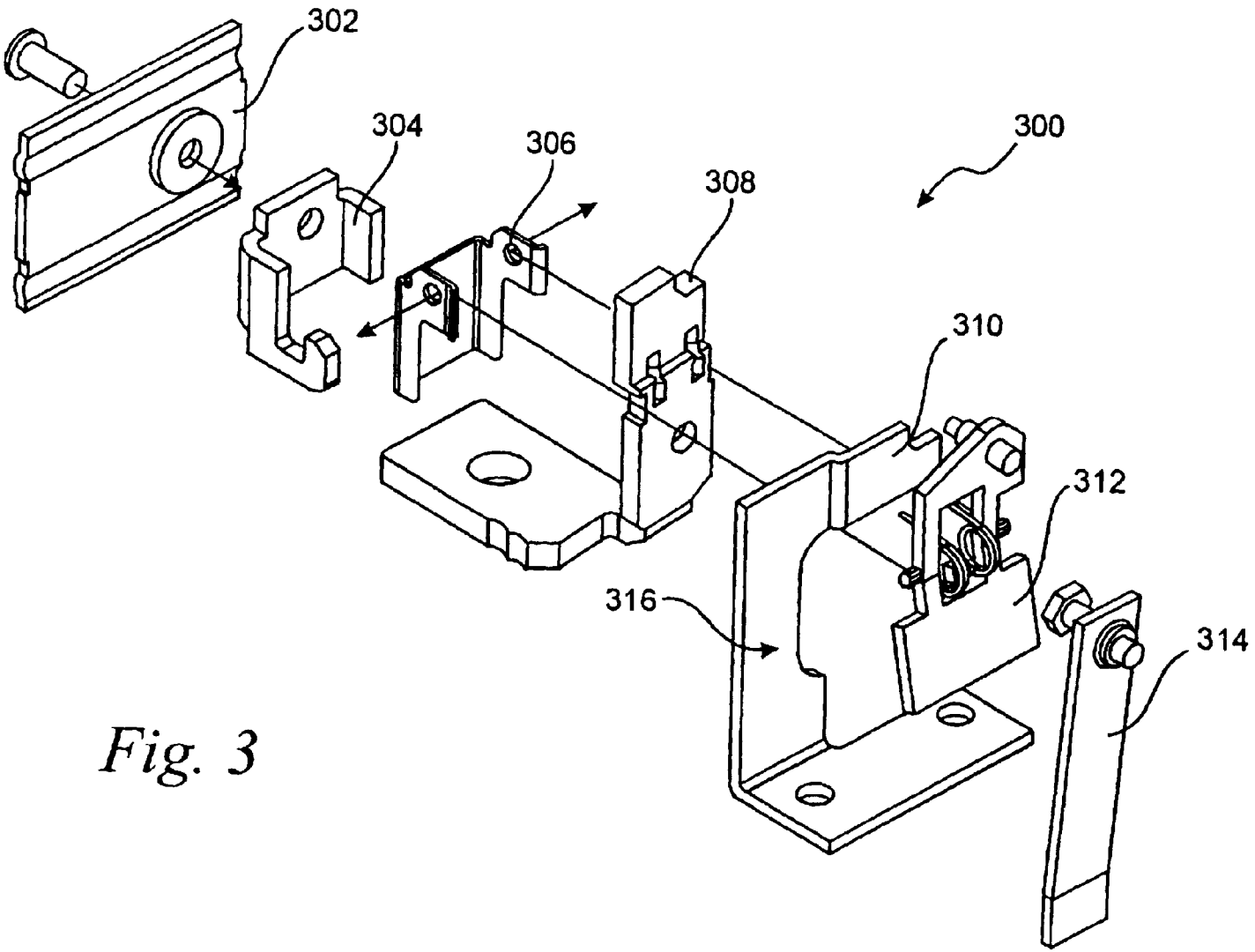
FIG. 3 is an exploded view of a trip assembly in accordance with another aspect of the present invention.
Figure 4:
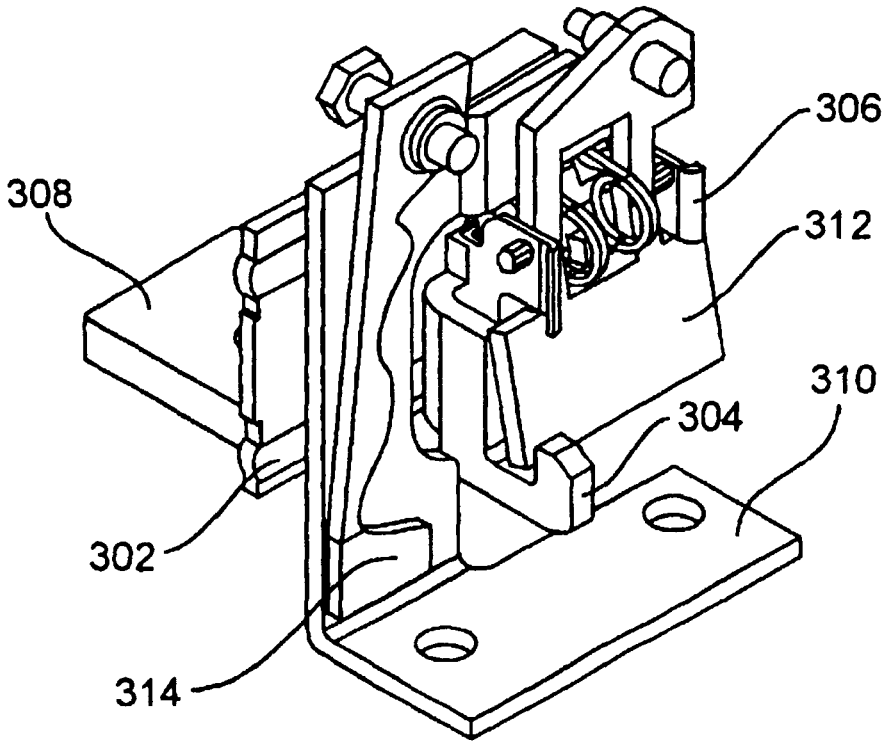
FIG. 4 is perspective view of the trip assembly shown in FIG. 3 in assembled form.
Figure 5:
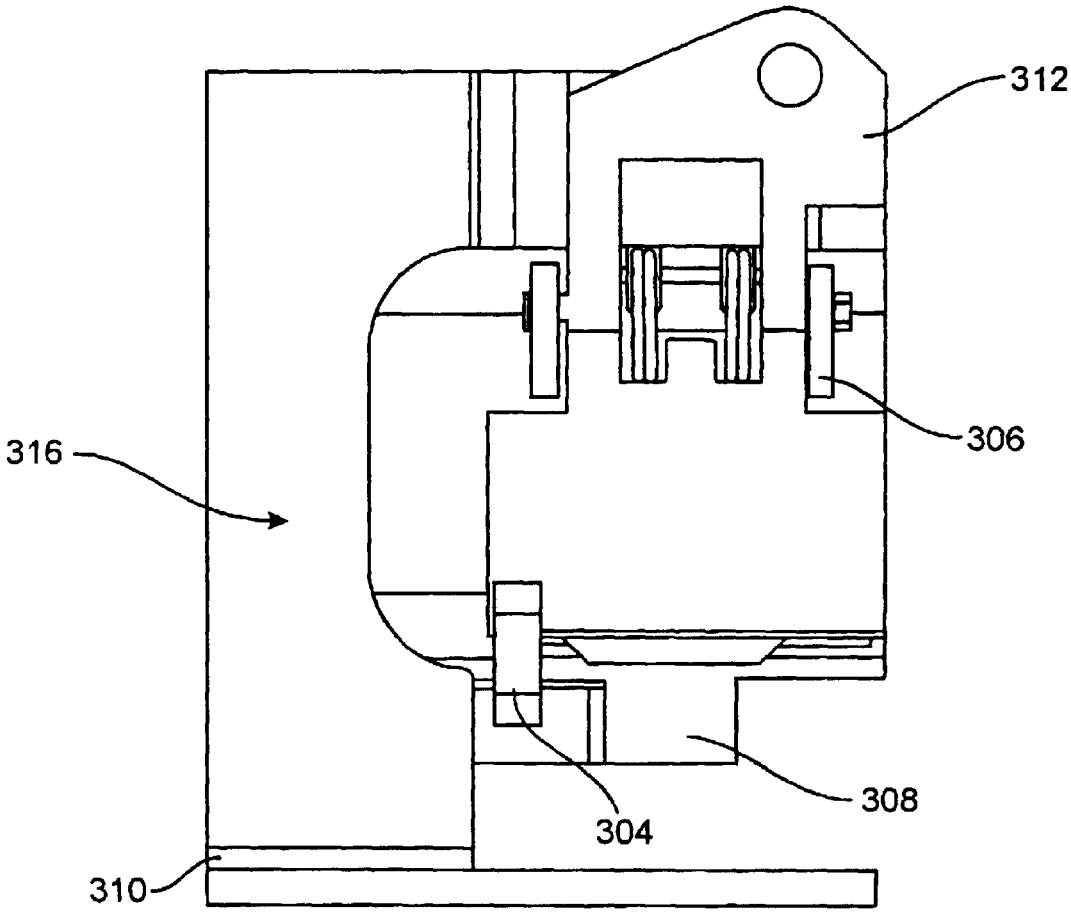
FIG. 5 is an end view of the assembled trip assembly shown in FIG. 4.

FIG. 3 shows an exploded view of a trip assembly 300 having a heater 310 that as a different geometric shape from the heater 210 shown in FIG. 2. The trip assembly 300 also includes a strip 314, which has the same composition as the strip 214. The heater 310 is composed of the same material as the heater 210 and includes a plate section 316. The primary difference between the trip assembly 300 shown in FIG. 3 and the trip assembly 200 shown in FIG. 2 is that plate section 316 of the heater 310 has a smaller cross-sectional area A2 (shown in FIG. 7) than section 216 of the heater 210. The trip assembly 300 is shown fully assembled in FIG. 4. Note that the strip 314 has been partially cutaway for illustrative purposes to reveal the section of the heater 310 partially obscured behind. An end view of the assembled trip assembly 300 shown in FIG. 4 is diagramatically illustrated in FIG. 5. Note that the strip 314 is not shown for ease of illustration.

As a result of the reduced cross-sectional area A2 of the plate section 316 relative to the cross-sectional area A1 of the plate section 216, the heater 310 will generate more heat in response to an increasing current than the heater 210, causing the strip 314 to deflect by a greater amount than the strip 316. By way of example and not as a limitation, the strip 214 deflects sufficiently to trip a trip cross bar when the current through the heater 210 is greater than 80 amperes (within a predetermined tolerance) over a predetermined period of time, whereas the strip 314 deflects sufficiently to trip the trip cross bar when the current through the heater 310 is greater than 70 amperes (within a predetermined tolerance) over a predetermined period of time.

As the heater 310 generates more heat, the strip 314 deflects in a direction away from the plate section 316 of the heater 310. The direction of deflection is best viewed with reference to FIG. 4. Although the strip 314 is shown to be generally flat, in other embodiments the strip 314 may have different shapes, such as curved or coiled As previous explained, the shape of the heaters 210, 310 shown in FIGS. 6 and 7, respectively, differs in that the cross-sectional area A1 of the plate section 216 shown in FIG. 6 is greater than the cross-sectional area A2 of the plate section 316 shown in FIG. 7. The plate section 216 includes end portions 220, 222 and a middle portion 224. Similarly, the plate section 316 includes end portions 320, 322 and a middle portion 324. Thus, the shapes of the heaters 210, 310 also differ insofar as the middle portions 224, 324 have different surface areas. In the illustrated embodiments, the plate sections 216, 316 have the same thickness. The arrangement of the illustrated end portions 220, 222 and middle portion 224 results in a shape that is generally C- or U-shaped.

In other embodiments, the shape of the heaters 210, 310 is varied by, for example, varying the thickness of a section of the heaters, such as sections 216, 316, in addition to or in lieu of varying the width. In another embodiment, the shape of the heaters 210, 310 is varied by forming at least one aperture that depends into a section of the heaters, such as plate sections 216, 316. Note that the shape of the heaters 210, 310 may be varied by altering a section other than sections 216, 316. In general, the shape of the heater 210 differs from the shape of the heater 310 such that the electrical resistance presented to current passed through the heater is varied. The heaters 210, 310 are also composed of the same material. Likewise, the strips 214, 314 are also composed of the same material, although not necessarily the same material as the heaters 210, 310 are composed of.

Although the various sections of the heaters 210, 310 are generally rectangular, one or more sections in other embodiments may be generally cylindrical. In these other embodiments, the radius of the cross-sectional area of the cylindrical section may be varied to achieve different current ratings.

Figure 8:
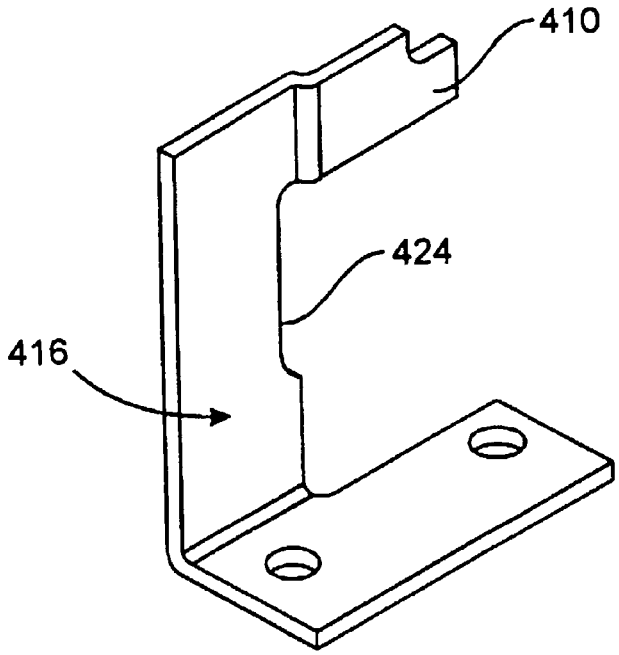
FIG. 8 is a perspective view of a heater suitable for use in an embodiment of the present invention.
Figure 9:
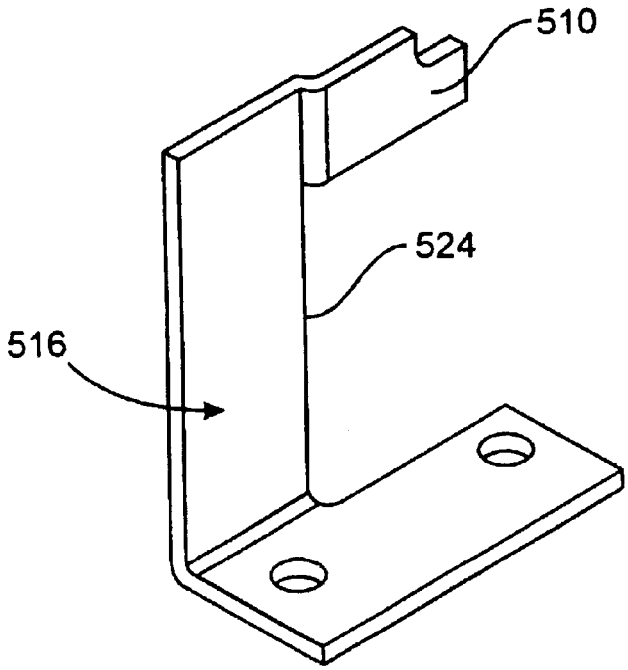
FIG. 9 is a perspective view of a heater having a different shape from the shape of the heater shown in FIG. 8.
Figure 10:
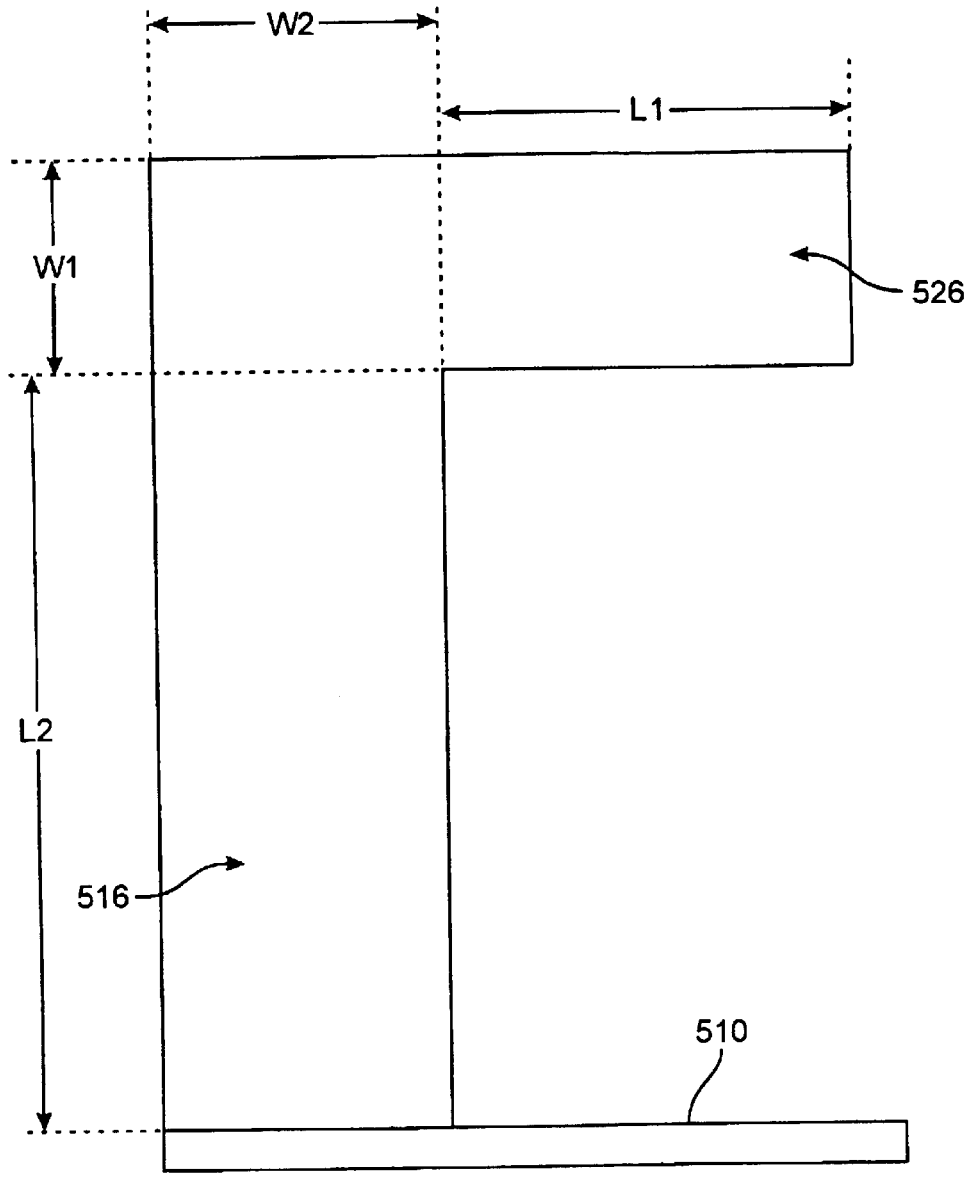
FIG. 10 is a schematic illustration of a top view of the heater shown in FIG. 9.

FIGS. 8 and 9 illustrate a heater 410 and a heater 510, respectively, each having a different shape from one another but composed of the same material. Accordingly, heaters 410, 510 have the same watts loss for different current ratings of the circuit breaker (e.g., heater 410 provides a current rating of 80 A, whereas heater 510 provides a current rating of 90 A, but both heaters 410, 510 have the same watts loss), and when strips composed of the same bimetal are attached to the heaters 410, 510, the same deflection curve is obtained. The initial shape of the heater 510 is modified to produce the shape of the heater 410 by removing a middle portion 524 of the heater 510 such that the middle portion 424 is obtained. Note that the cross-sectional area of the middle portion 424 is less than the cross-sectional area of the middle portion 524, and therefore, the heater 410 will achieve a lower current rating than the heater 510. The resulting heater 410 may be produced by using a conventional die and neff press to form the desired shape. To form an aperture according to some embodiments, a drill may be used with appropriate centering equipment to ensure accuracy, particularly where production is limited.

Next, a specific example of forming two heaters from the heater 510 having an initial shape will be described. The heater material used is CDA 706, and the bimetal strip used is P150RC. First, the resistances of six different heaters used in circuit breakers commercially available from the assignee of the present invention were measured. A watts loss was calculated from the measured resistances based on the rated current for each heater. The following values were obtained:

| Measured Heater Resistance | Rated Current | Watts Loss |
|---|---|---|
| 0.000355 Ω | 100A | 3.55 W |
| 0.000231 Ω | 125A | 3.61 W |
| 0.000180 Ω | 150A | 4.05 W |
| 0.000153 Ω | 175A | 4.69 W |
| 0.000086 Ω | 200A | 3.44 W |
| 0.000050 Ω | 225A | 2.53 W |

To obtain a target watts loss based on calibration, the watts losses of the 150 A and 200 A heaters were averaged, resulting in a target watts loss of 3.745 W. Three new desired resistance values were calculated for a 70 A rating, an 80 A rating, and a 90 A rating using the target watts loss. The new resistance values are 0.0007643Ω, 0.0005852Ω, and 0.0004623Ω, respectively.

The heater 510 shown in FIG. 9 was selected as the initial heater shape. The geometry of the heater 510 was mathematically broken into two cross-sectional areas, A and $A_{fixed}$. The thickness, T, of the heater 510 is a uniform 0.064 inches. $A_{fixed}$ corresponds to T×W1, where W1 is 0.308 inches and $A_{fixed}$ is 0.0197 in$^2$. A (the web cross-sectional area) corresponds to T×W2, where W2 is 0.453 inches and A is 0.290 in$^2$. L1 is 0.594 in and L2 is 1.09 in. The resistivity of the heater 510 is 115 Ω-CM/ft. Tolerances were allowed for each dimension as follows:

| Dimension | Nominal Value | Tolerance |
|---|---|---|
| W1 | 0.308 in | 0.01 |
| L1 | 0.594 in | 0.03 |
| W2 | 0.453 in | 0.015 |
| L2 | 1.092 in | 0.015 |
| T | 0.064 in | 0.002 |

The measured resistance of the heater 510 was 0.000555Ω resulting in a nominal watts loss of 4.13 W. The measured resistance of the heater 510 was higher than the desired new resistance value of 0.00046Ω, but within acceptable limits based on the tolerances.

Figure 7:
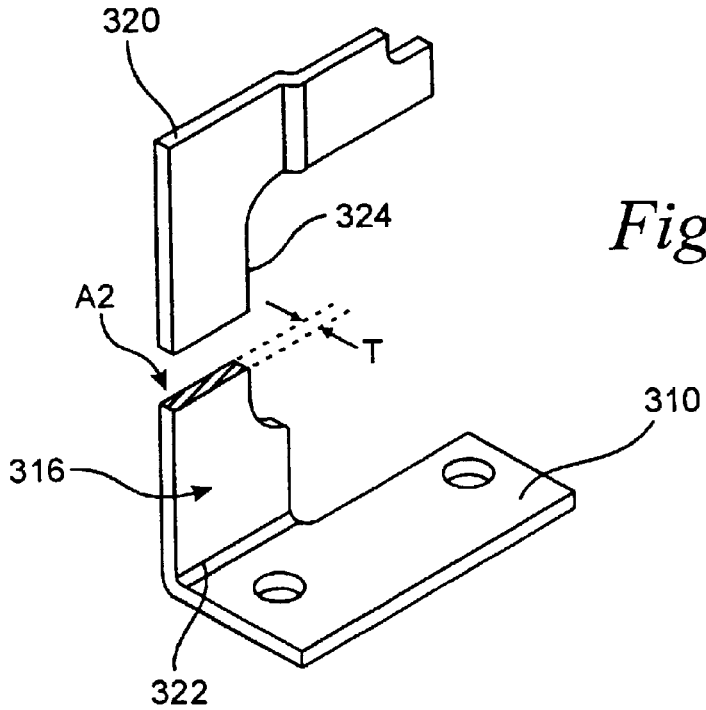
FIG. 7 is a perspective cutaway view of the heater shown in FIG. 3.

To calculate the width of webs for the new cross-sectional areas, A1 and A2, shown in FIGS. 6 and 7, the following formula was applied.

$$\frac{L2 \cdot k \cdot \rho \cdot A1}{T \cdot [(R \cdot A1) - (L1 \cdot k \cdot \rho)]}$$

As is known, k is a conversion factor corresponding to $6.545\times10^{-8}$. Using the desired new resistance values for the 70 A and 80 A current ratings, the new areas A1 and A2 shown in FIGS. 6 and 7 resulted in 0.0153 in$^2$ for the 70 A rating and 0.029 in$^2$ for the 80 A rating. Dividing the new areas A1 and A2 by the thickness, T, (0.064 in) yielded the widths (hereafter $W_{web}$) of areas A1 and A2 as 0.239 in and 0.359 in, respectively. Subtracting these widths from the width, W2, of the heater 510 yielded difference webs, $W_{diff}$ of 0.214 in and 0.0945 in, respectively. These difference webs ($W_{diff}$) correspond to the width of material that must be removed from the area 516 of the heater 510 in order to achieve the target watts loss for the heaters 410, 310 shown in FIGS. 11 and 12, respectively.

Figure 11:
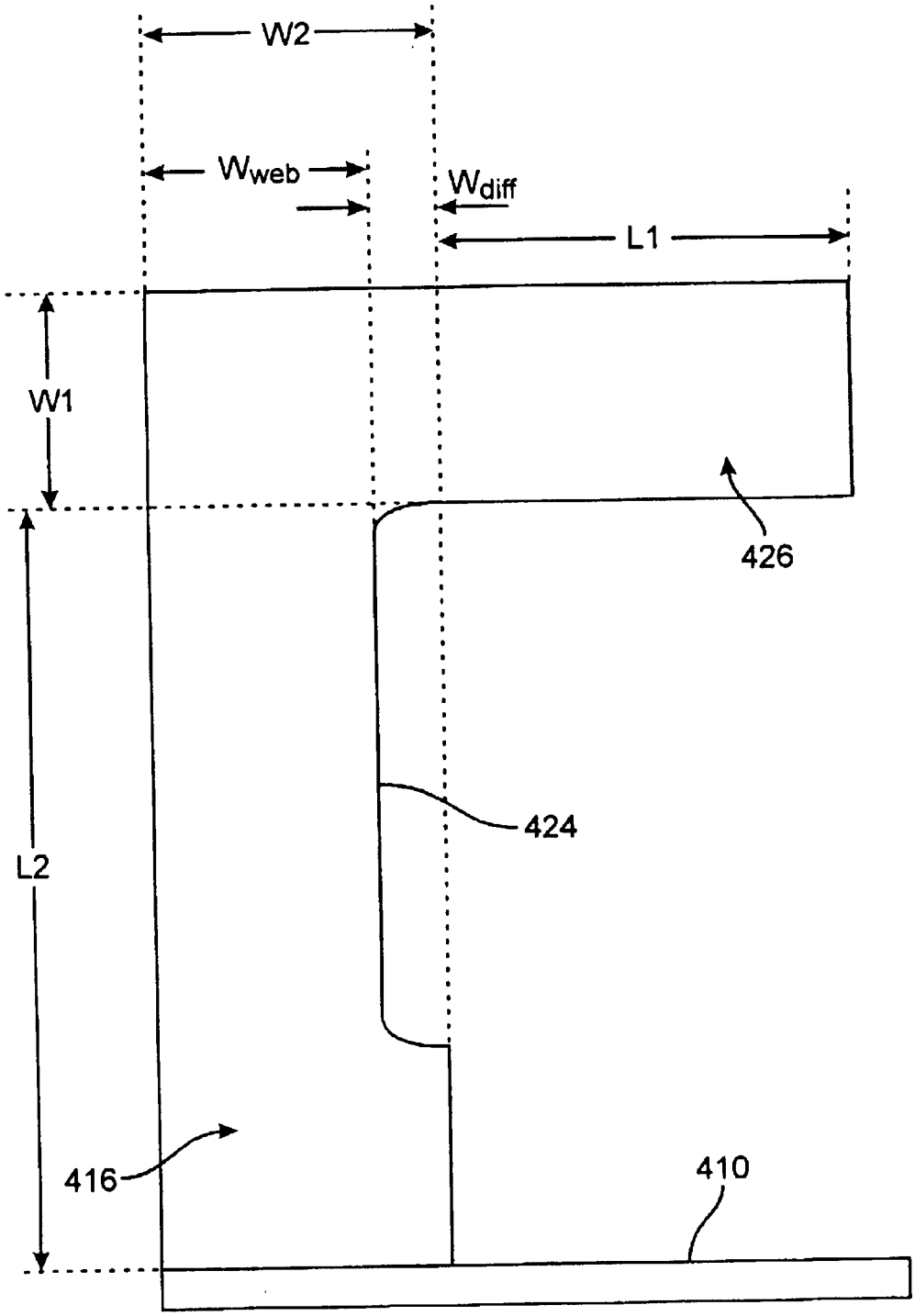
FIG. 11 is a schematic illustration of a top view of the heater shown in FIG. 8.
Figure 12:
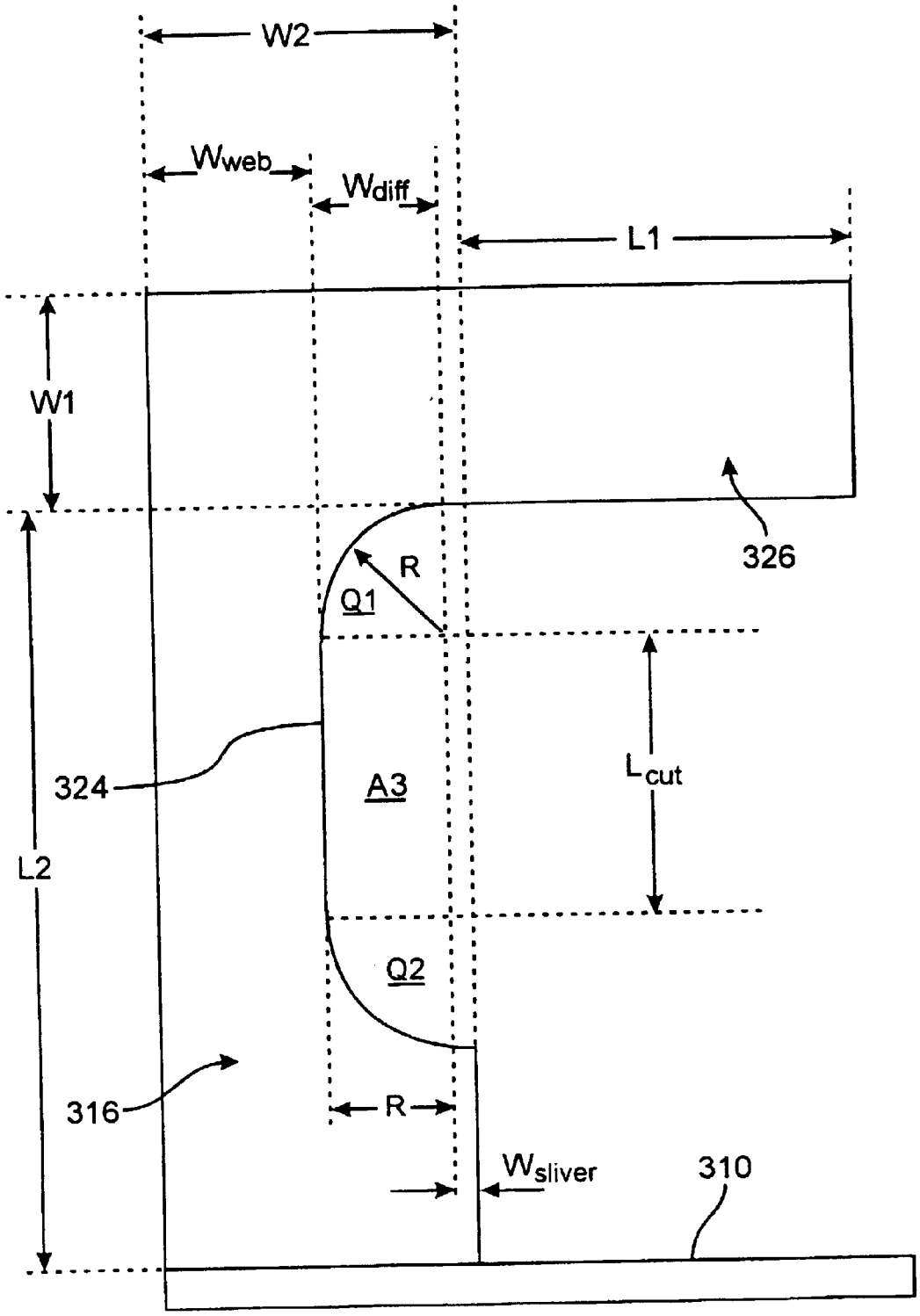
FIG. 12 is a schematic illustration of a top view of the heater shown in FIG. 3.

In the heaters 310, 410 shown in FIGS. 11 and 12, the corners of the removed area were rounded to reduce the effects of current crowding or high local current density which occurs near sharp corners. The radius, R, of the cutout area was selected to be 0.2 inches. The total width of the difference web to be removed from the heater 510 to form heater 310 is 0.214 in, which exceeds R by 0.014 in. The width of the cutout portion cannot exceed R, because otherwise a sharp point will be created if the radial curvature of the cut is maintained to the edge 324 of the heater 310. Accordingly, to avoid undesired current crowding or high local current density which would occur at this sharp point, a rectangular sliver was first removed from the heater 510. The width of this sliver, $W_{sliver}$, corresponds to 0.014 in, the amount by which the difference web exceeded the limit of R. The length of the sliver, $L_{cut}$, is 0.742 in, leaving 0.35 in for attachment of the bimetal strip 314.

The area A3 shown in FIG. 12 has a width of R (or 0.2 in) and a length of $L_{cut}$-2R or 0.342 in. There are two quadrants, Q1 and Q2, which form the curved transition between the edge 324 of the heater 310 and the lower edge of area 326. To form the heater 410, the same radial curvature was followed, however, no sliver was needed because the width of the area to be removed did not exceed the limit of 0.2 in (only 0.0945 in of width needed to be removed from the heater 510 to form the heater 410 shown in FIG. 11). The watts loss for the heaters 310, 410 was 3.75 W, which was relatively close to the target watts loss of 3.745 W. Further adjustments may be made by turning the adjustment screw shown on the bimetal strip 314 in FIG. 3, for example.

The foregoing values and calculations are exemplary only, and are intended to apply to a specific embodiment only of the present invention. Those skilled in the art will appreciate how to apply the teachings of the present invention to derive geometries for other heater/bimetal combinations and for other current ratings.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A heater element for use in a circuit breaker trip assembly, said heater element comprising a plate of a first heater material and having a first thickness and a first surface area, said first surface area being variable for achieving a predetermined thermal characteristic in response to an electrical current passed through said heater element, whereby the shape of said plate can be modified for use in circuit breaker trip assemblies having various trip ratings.

2. The heater element of claim 1, wherein said predetermined thermal characteristic is watts loss.

3. The heater element of claim 1, wherein said predetermined trip characteristic is a thermal behavior over a predetermined period of time.

4. The heater element of claim 1, wherein said first surface area has a geometry that is generally C-shaped.

5. The heater element of claim 1, wherein said plate has a first and second end portion and a middle portion, said first surface area being variable by changing the shape of said middle portion.

6. The heater element of claim 1, in combination with a bimetal electrically coupled to and indirectly heated by said heater element as current is passed through said heater element, wherein the various trip ratings are achieved independent of the composition of said bimetal.

7. A method of forming a heater element for use in a circuit breaker trip assembly, the method comprising:

forming a heater element of a first heater material and having a first thickness and a first surface area, and adjusting said first surface area to a surface area for achieving a predetermined thermal characteristic in response to an electrical current passed through said heater element;

whereby a modified heater element having the same initial shape can be modified for use in circuit breaker trip assemblies having various trip ratings.

8. The method of claim 7, wherein said adjusting is carried out by varying a width dimension of said first surface area and maintaining a length dimension and said thickness constant.

9. The method of claim 7, further comprising adjusting said thickness to a thickness for achieving said predetermined thermal characteristic.

10. The method of claim 7, wherein said adjusting is carried out by removing a portion of said first surface area.

* * * * *